US005254189A

United States Patent [19]

Hirobe et al.

[11] Patent Number: 5,254,189

[45] Date of Patent: Oct. 19, 1993

[54] LABELLING METHOD AND APPARATUS THEREFOR

[75] Inventors: Kenji Hirobe; Maplo Takama, both of Kurita, Japan

[73] Assignee: Ishida Scales Mfg. Co., Ltd., Kyoto, Japan

[21] Appl. No.: 877,185

[22] PCT Filed: Nov. 26, 1991

[86] PCT No.: PCT/JP91/01641

§ 371 Date: Jul. 6, 1992

§ 102(e) Date: Jul. 6, 1992

[87] PCT Pub. No.: WO92/09485

PCT Pub. Date: Jun. 11, 1992

[30] Foreign Application Priority Data

Nov. 30, 1990 [JP] Japan ..... 2-338322

[51] Int. Cl.[5] ..... B65C 9/00

[52] U.S. Cl. ..... 156/64; 156/360; 156/363; 156/542

[58] Field of Search ..... 156/542, 360, 361, 362, 156/363, 64

[56] References Cited

U.S. PATENT DOCUMENTS

| | | | |
|---|---|---|---|
| 3,616,016 | 10/1971 | Dinter | 156/542 |
| 4,189,337 | 2/1980 | Higgins et al. | 156/541 |
| 4,210,484 | 7/1980 | Crankshaw et al. | 156/542 |
| 4,255,220 | 3/1981 | Kucheck et al. | 156/542 |
| 4,294,644 | 10/1981 | Anderson | 156/361 |
| 4,844,771 | 7/1989 | Crankshaw et al. | 156/542 |

FOREIGN PATENT DOCUMENTS

| | | |
|---|---|---|
| 57-36572 | 8/1982 | Japan . |
| 62-13931 | 4/1987 | Japan . |
| 63-177210 | 11/1988 | Japan . |

*Primary Examiner*—David A. Simmons
*Assistant Examiner*—William J. Matney, Jr.
*Attorney, Agent, or Firm*—Staas & Halsey

[57] ABSTRACT

In a weighing and labelling system for a product, a suction unit (35) having its lower surface carrying a label (Z) is lowered by a drive motor (25) and, immediately before the suction unit (35) is brought into contact with a product (Y) to be wrapped, the supply of an electric power to the drive motor (25) is interrupted to allow the label (Z) to be applied to the product (Y) by the effect of an inertia operation and, thereafter, the suction unit (35) is immediately elevated. Alternatively, by the utilization of a servo mechanism, the label (Z) is applied.

7 Claims, 9 Drawing Sheets

Fig. 6
| Product Number |
|---|
| ∘ Product Name |
| ∘ Unit Price etc. |
| ∘ Tray Number |
| ∘ Tray Data |
| ∘ Package Condition |
| ∘ Product Height |
| |
Fig. 7
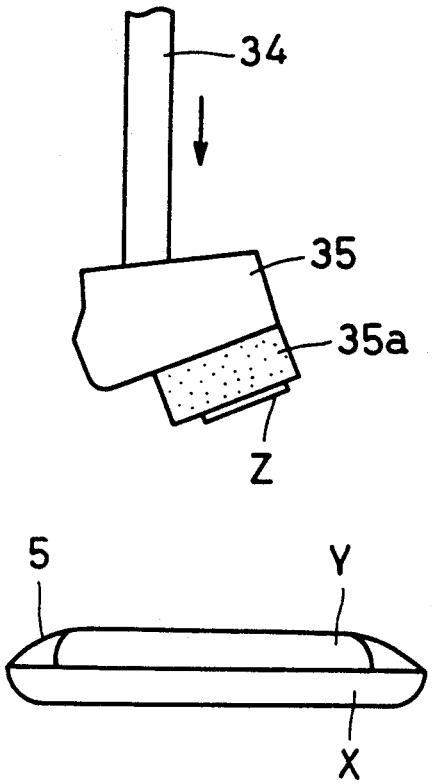
Fig. 8
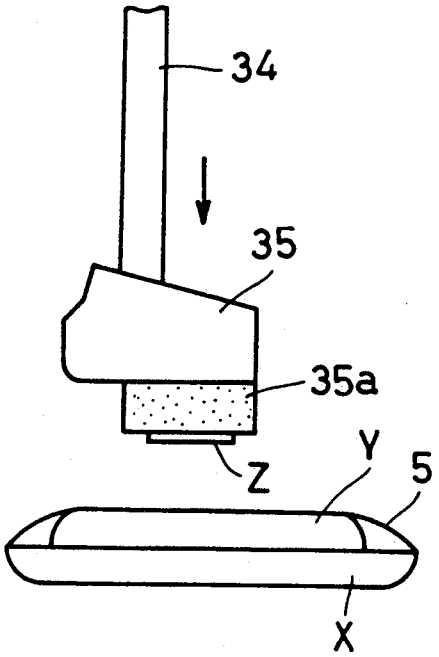
Fig. 9
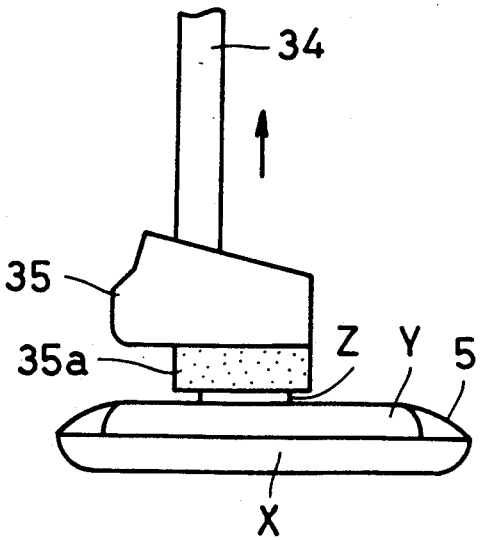

LABELLING METHOD AND APPARATUS THEREFOR

FIELD OF THE INVENTION

The present invention relates to a method of and an apparatus for applying labels on products suited for use in, for example, a product weighing system.

BACKGROUND ART

In a packaging center where products intended for sale in supermarkets are packaged, a weighing and labelling system is generally employed for automatically and continuously executing jobs of weighing the products, calculating the price of each product based on the weight determined as a result of the product weighing job, printing the price and the weight on a respective label and applying the respective label to the corresponding product.

This weighing and labelling system is provided with a label printer for printing and issuing the price on the label and a label applying device for receiving the label issued by the label printer and applying it onto the product automatically. An example of this label applying device is disclosed in, for example, Japanese Utility Model Laid-open Application No. Sho-61-83508.

The prior art label applying device includes a suction head for sucking and holding a label issued from a label discharge opening of the label printer, a lift mechanism for lowering and elevating the suction head, and a drive motor for driving the lift mechanism and is so designed that, by lowering the suction head by means of the drive of the motor, the label held by the suction head can be applied to a product positioned below the suction head.

According to known prior art label applying devices, the suction head is elevated when the suction head receives a predetermined reactive force from the product. Therefore, when it comes to applying the label to an easily deformable product such as tofu or fried potato pudding, as shown in FIG. 15, the product C tends to be strongly pressed by a cushioning member B fitted to the suction head A to such an extent that the product C may be crushed or a marking of a press may be left on the product C, resulting in a reduction in commercial value of the product C.

Accordingly, so far as fragile products are concerned such as discussed above, labels are conventionally applied to the products manually.

In production factories a device is known which is so designed that, after a label holder has been lowered a predetermined distance by means of a pneumatic cylinder, switching is effected to apply air pressure required to elevate the label holder by detecting approach of the label holder towards the work, and wherein the label holder is caused to contact the work by the downward motion of the label holder thereby to apply the label to the work (See Japanese Utility Model Publication No. Hei-3-31687). According to this prior art, since the label is applied to the work while the air pressure has been switched in a condition required to elevate the label holder, the possibility of the product being damaged is reduced.

However, if, in an attempt to further avoid possible damage to the product, a lowermost limit position to which the label holder is lowered by the effect of an inertia is defined at a position very close to an upper surface of the product, the label applying device will fail to properly apply the label to the product due to a variation in stroke of downward movement of the label holder.

The present invention has been devised with due regard to the above discussed conventionally experienced problems, and has for its essential object to provide a labelling method and an apparatus therefor which are effective to minimize any possible damage to the products and also to properly apply the labels to the respective products.

Also, according to the foregoing prior art, since the label holder is lowered by the action of pneumatic pressure, the speed of downward movement tends to be so unstable as to result in a variation in stroke of downward movement by the effect of inertia. Also, since the viscosity of oil in sliding parts of the penumatic cylinder changes with changes in the temperature of surrounding air or that of the label applying device, deceleration of the label holder tends to be so unstable as to result in variation in stroke of downward movement by the effect of inertia. Accordingly, it often occurs that the stroke exceeds a predetermined value thereby imparting damage to the product, or the stroke falls short of the predetermined value thereby to fail to properly apply the label to the product.

Accordingly, another object of the present invention to minimize the variation in stroke of downward movement during application of the label to the product thereby to accomplish the above described object.

DISCLOSURE OF THE INVENTION

In order to accomplish the above described object, a labelling method of the present invention is such that the drive of the suction head in the applying direction is interrupted immediately before the suction head being lowered arrives at a label applying surface of the product to permit the label to be subsequently applied by the effect of an inertia operation, and the detection is made of an upward leap of the suction head in response to a reaction which has occurred at the time of application of the label and, after this detection, the suction head is elevated.

In this labelling method, since the suction head is elevated after the upward leap of the suction head in response to the reaction which has occurred when the label is applied to the product, the suction head can be assuredly brought into contact with the top face of the product. Accordingly, not only can the label be accurately applied to the product, but also it is not necessary to ascertain whether or not the label has been applied to the product.

In a preferred embodiment of the method of the present invention, the suction head is elevated after the suction head leaps upwardly for the first time.

In this way, it is possible to avoid contact of the suction head with the product in a repeated number, and therefore, possible damage to the product can be further avoided and, at the same time, the cycle time of labelling can be reduced.

Also, in order to accomplish the above described object, the labelling apparatus of the present invention is provided with a drive means for moving the suction head up and down, a descent detecting means for detecting a lowering of the suction head down to a predetermined position, and a drive interrupting means for interrupting the drive of the drive means in an applying direction in the event that the lowering of the suction head down to the predetermined position has been detected by the descent detecting means. Also provided is a reverse detecting means for detecting a upward leap of the suction head when the drive of the drive means is interrupted, and a drive direction reversing means for driving the drive means in a reverse direction in response to a reverse signal fed from the reverse detecting means.

In this labelling apparatus, since the provision is made of the reverse detecting means for detecting the upward leap of the suction head so that the drive means can be driven in the reverse direction in response to the reverse signal from the reverse detecting means, the suction head can be properly brought into contact with the top face of the product. Accordingly, not only can the label be properly applied to the product, but also no necessity occur to ascertain the application of the label.

In a preferred embodiment of the apparatus of the present invention, the drive means of a drive motor and the drive interrupting means is constituted by a power source cutting means operable to interrupt the supply of an electric power to the drive motor.

In this embodiment, since the suction head is lowered by the drive motor, not by a pneumatic cylinder, the speed at which the suction head is lowered can be stabilized. In other words, the suction head can be lowered at a predetermined speed and, because of this reason, no variation in stroke of lowering under the effect of inertia occurs. Also, since, unlike the pneumatic cylinder, no unstable deceleration which would otherwise occur as a result of a change in viscosity of oil in sliding parts occurs, and therefore, no variation in stroke of lowering under the effect of the inertia occurs. Accordingly, there is no possibility that the stroke may exceed or decrease below the predetermined value and, therefore, the label can be assuredly applied without giving damage to the product.

In a further preferred embodiment of the apparatus of the present invention, the above described drive direction reversing means drives the drive means in the reverse direction in response to the initial upward leap of the suction head.

In a still further preferred embodiment of the apparatus of the present invention, the provision is made of a memory for storing the height of the product for each kind of the product, and a lowering amount calculating means for calculating the lowering amount, over which the suction head should be lowered while being driven, on the basis of the height of the product stored. The above described descend detecting means detects the lowering of the suction head down to the predetermined position on the basis of the above described preset lowering amount.

In this way, no provision may be made of a sensor capable of being lowered together with the suction head for detecting whether or not the suction head has approached the product. Accordingly there is no possibility that lead wires of the sensor movable up and down may be damaged or twined, and, therefore, the apparatus is excellent in durability and reliability.

In a preferred embodiment of the present invention, there is provided a lifter for elevating the product towards a wrapping station, a product detecting sensor secured to a frame for detecting an upper edge of the product while the product is elevated, a height calculating means for calculating the height of the product in reference to the length of time required to elevate the product before the product has been detected, and a lowering amount calculating means for calculating, on the basis of the height of the product so calculated, the preset lowering amount over which the suction head being driven is to be lowered. The above described descend detecting means detects the lowering of the suction head down to the predetermined position having moved the preset lowering amount.

Also, in order to accomplish the above described objects, the labelling method of the present invention is such that, while provision is made of a servo motor for moving the suction head up and down, the servo motor is brought to a halt when the suction head is lowered to the predetermined position while the position of the suction head is detected.

Also, in order to accomplish the above described object, the label applying apparatus of the present invention is provided with a servo motor for moving the suction head up and down, and a servo controller for bringing the servo motor to a halt when the suction head is lowered down to the predetermined position while the position of the suction head is detected.

In this label applying apparatus, since the servo motor is controlled by the servo controller, the suction head can be accurately brought to a halt at the predetermined position and, therefore, the label can be applied to the product without giving damage to the product.

BRIEF DESCRIPTION OF THE DRAWINGS

FIG. 6 illustrates a structure of a memory used in this system;

FIGS. 7, 8 and 9 are side views showing the sequence of operation of a first embodiment;

BEST MODE FOR CARRYING OUT THE INVENTION

Hereinafter, embodiments of the present invention will be described with reference to the drawings.

Figure 1:
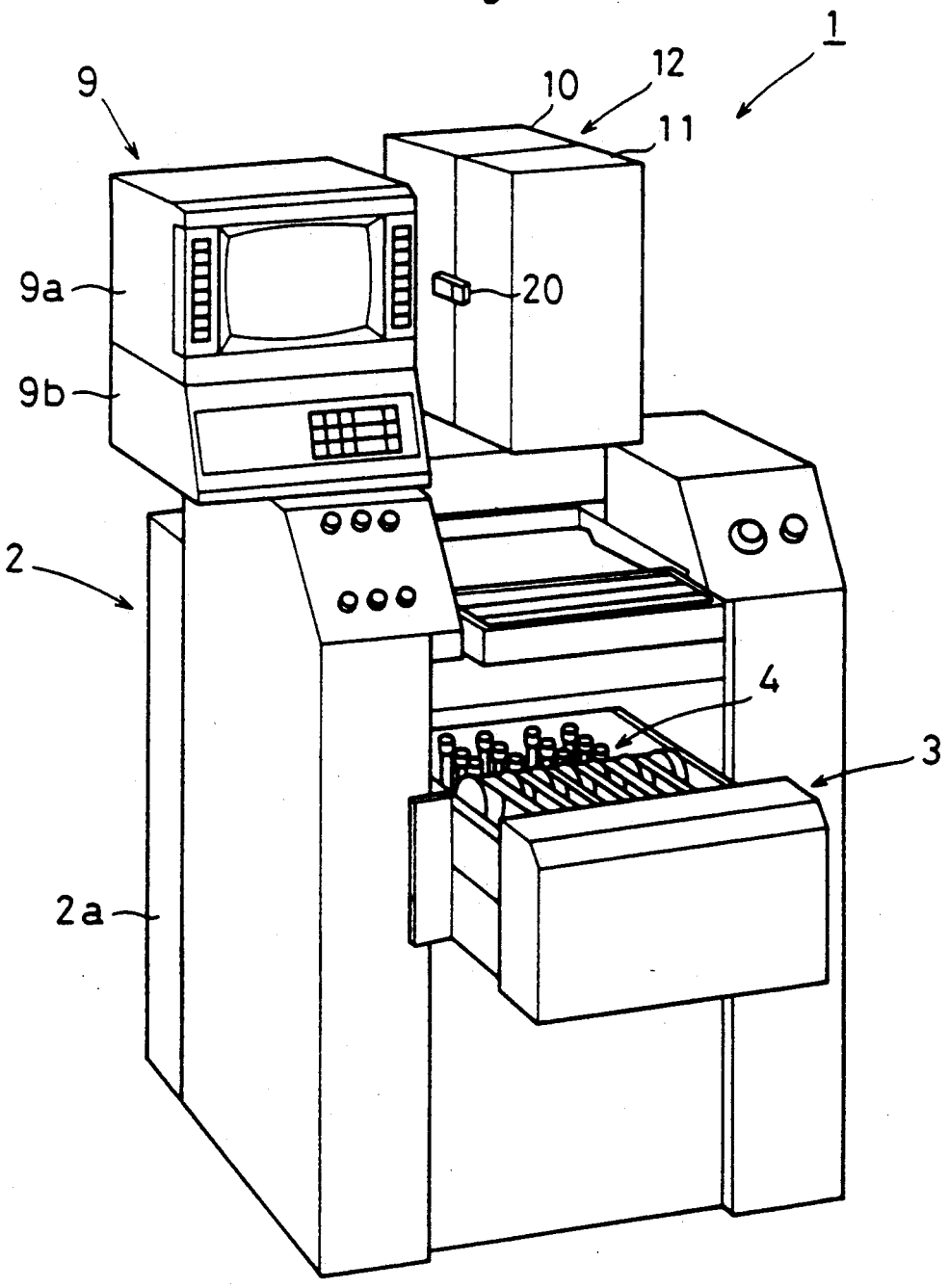
Fig. 1 PRIOR ART
FIG. 1 is a perspective view showing an outer appearance of a packaging and labelling machine.

As shown in FIG. 1, a packaging and labelling machine 1 according to this embodiment includes a weighing mechanism 3 disposed at a front center portion of a housing *2a* of a packaging device 2. This weighing mechanism 3 is operable to weigh a product Y to be wrapped which is accommodated in a tray X (See FIG. 2). Positioned rearwardly of this weighing mechanism 3 is a lifter 4 for receiving the weighed product Y to be wrapped shown in FIG. 2 and for subsequently lifting the product Y towards a wrapping station S defined thereabove. A wrapping mechanism 6 for wrapping the product at the wrapping station S is disposed above the lifter 4. This wrapping mechanism 6 is operable to wrap the product Y together with the tray X up in a film 5 at the wrapping station S. A sealing mechanism 7 is disposed at a position frontwardly F of the wrapping station S and above the weighing mechanism 3. This sealing mechanism 7 is operable to thermally seal the film 5 which has been folded at the bottom of the tray X. A pusher 8 is operable to push the wrapped product Y from rear to eject the wrapped product Y onto the sealing mechanism 7.

A console box 9 is mounted atop the housing 2*a* of the packaging device 2. This console box 9 has a display unit 9*a* and an operating unit 9*b* and accommodates therein a control unit 41 (See FIG. 5) as will be described later. The control unit 41 is used to control operations of various component parts of the packaging and labelling apparatus 1 and also to calculate the price of the wrapped product Y on the basis of a signal indicative of the weight of the wrapped product Y which has been weighed by the above described weighing mechanism 3.

Figure 2:
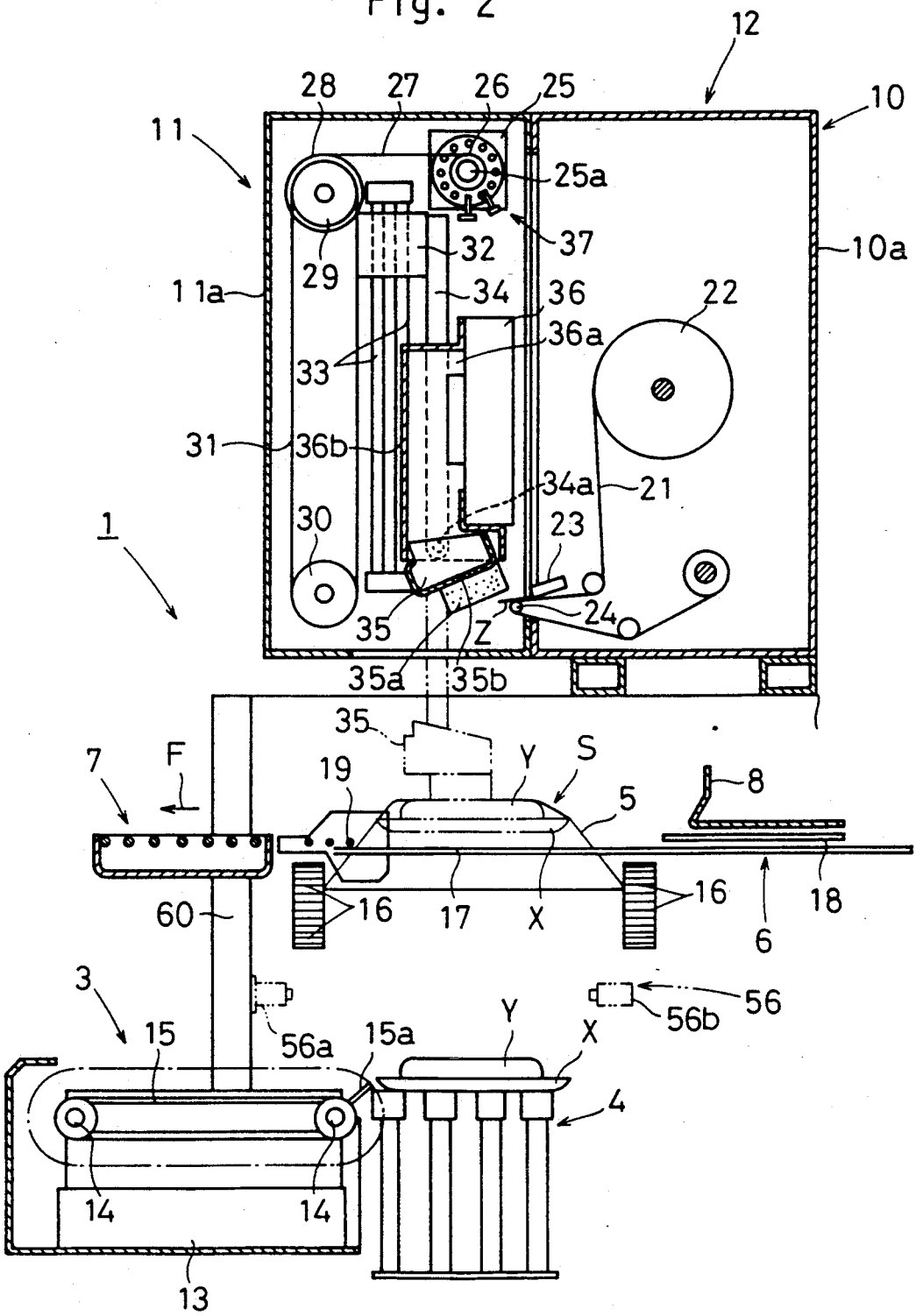
FIG. 2 is a sectional view of a label applying device.

Disposed laterally of the console box 9 is a labeling machine 12. The labelling machine 12 comprises, as shown in FIG. 2, a label printer 10 and a label applying device 11. The label printer 10 is operable in response to a signal from the control unit 41 (FIG. 5) to print the weight and the price of the wrapped product Y on a label Z and then issue the label Z. The label applying device 11 is operable to apply the label Z, which has been issued by the label printer 10, to the wrapped product Y wrapped in the film 5 at the wrapping station S.

Hereinafter, the various component parts will be described in detail.

The weighing mechanism 3 includes a weighing scale 13 for measuring the weight of the product Y to be wrapped and a plurality of conveyor belts 15, . . . and 15 trained between a pair of pulleys 14 and 14 mounted atop the weighing scale 13. These conveyor belts 15, . . . and 15 have fixed thereon projections 15*a*, . . . and 15*a* adapted to press one end of the tray X to transport the tray X towards the lifter 4. Accordingly, the product Y to be wrapped which is placed on the conveyor belts 15, . . . and 15 is, after having been weighed, delivered onto the lifter 4 together with the tray X by means of the projections 15*a*, . . . and 15*a* on the conveyor belts 15, . . . and 15.

The lifter 4 is disposed immediately beneath the wrapping station S and is supported for movement up and down by means of an elevating means not shown. This lifter is, when the product Y to be wrapped is delivered from the weighing mechanism 3, elevated to lift the product Y to be wrapped and then urges the product Y to be wrapped against an undersurface of the film 5 retained in a stretched fashion at the wrapping station S.

On the other hand, at the wrapping station S, the film 5 has been supplied prior to a wrapping operation in a fashion with its opposite side edges in a widthwise direction thereof sandwiched by film delivery belts 16 and 16. This film 5 to be supplied is, after having been drawn outwardly from a film roll not shown and when the product Y is urged thereagainst by the lifter 4, sandwiched at its opposite side edges in the widthwise direction thereof by the film delivery belts 16 and 16 through said pressing operation and is then brought into close contact with the top surface of the product Y. In this condition, the wrapping mechanism 6 serves to fold the film 5 to bring front, rear, left-hand and right-hand side edges of the film 5 to the bottom of the tray X thereby to wrap the product Y to be wrapped.

The wrapping mechanism 6 includes a pair of left-hand and right-hand folder plates 17 and 17 (only one of which is shown in FIG. 2), a rear folder plate 18 and a front folder plate 19. The left-hand and right-hand folder plates 17 are adapted to move close towards each other from left-hand and right-hand sides laterally of the tray X to bring the left-hand and right-hand side edges of the film 5 to the bottom of the tray X, respectively. The rear folder plate 18 is adapted to move forwards from rear of the tray X to bring the rear side edge of the film 5 to the bottom of the tray X. The front folder plate 19 is driven incident to a discharge of the wrapped product Y by the operation of the pusher 8 driven at a predetermined timing synchronized with the rear folder plate 18, to bring the front side edge of the film 5 to the bottom of the tray X.

The label applying device 11 has a casing 11*a* connected to a front portion of a casing 10*a* of the label printer 10 by means of a hinge (not shown) for selective movement between open and closed positions. Accordingly, when the casing 11*a* of the label applying device 11 is opened, the interior of the label printer 10 and the label applying device 11 can be exposed to the outside. In this way, a loading of a roll of label sheet and/or servicing can readily be accomplished.

The roll 22 of label sheet 21 comprising a band of base sheet having a plurality of labels Z releaseably bonded thereto is disposed within the interior of the label printer 10. During a transport of the label sheet 21, drawn outwardly from this roll 22, over a distance from a printer head 23 to a platen roller 24, the weight and the price of the product Y to be wrapped are printed on one of the labels Z on the label sheet 21. Any one of the labels Z can be discharged while being peeled by a peel-off rod (not shown) engageable with a leading end of the associated label Z.

On the other hand, the label applying device 11 comprises drive mechanism, including a reversible drive motor (a driving means) 25, a drive pulley 26 mounted on a rotary shaft 25*a* of the drive motor 25, an upper pulley 29 rotatable together with a driven pulley 28 drivingly coupled with the drive pulley 26 through a transmission belt 27, a lower pulley 30 positioned therebelow, and a timing belt 31 trained between the pulleys 29 and 30.

The timing belt 31 has a base 32 fitted thereto and adapted to be guided along a pair of guide rods 33, 33 extending in a vertical direction. Fitted to the base 32 is a lifting arm 34 extending downwardly and through a suction chamber 36*a*. A lower end of the lifting arm 34 has a suction head 35 pivotally connected thereto through a hinge 34*a*. This suction head 35 has its lower end face formed with a plurality of suction ports 35*b*, and when the suction head 35 is held in an elevated position as shown by the solid line, the suction head 35 constitutes the substantially hermetically sealed suction chamber 36*a* in cooperation with a suction casing 36*b*. The suction chamber 36*a* accommodates therein a blower 36 and, therefore, a negative pressure produced by the blower 36 acts on an open-celled cushioning member 35*a*, secured to a lower portion of the suction head 35, through the suction ports 35*b* so that the printed label Z can be sucked up by this negative pressure.

More specifically, as shown by the solid line, when the suction head 35 is held in the elevated position, the suction head 35 closes an opening at the lower end of the suction casing 36*b* and, at the same time, the label Z is sucked onto a lower face of the cushioning member 35*a* retained in an inclined fashion. On the other hand, when the timing belt 31 is driven in a clockwise direction by means of the upper pulley 29 and the lower pulley 30, the cushioning member 35*a* is lowered together with the suction head 35 with the lower face of the cushioning member 35*a* held horizontally as shown by the double-dotted chain line. During this lowering, no negative pressure induced by the blower 36 acts on the label Z, but the label Z is lowered, while the label Z is supported on the lower face of the cushioning member 35*a* by the effect of an air resistance, and is then applied onto an upper face of the film 5 wrapped around the product Y then positioned therebelow.

Figure 3:
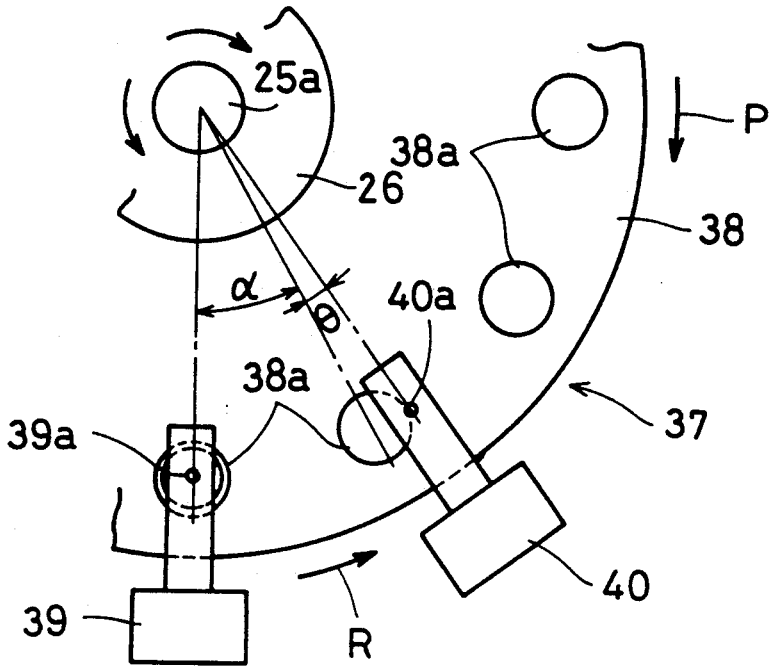
FIG. 3 is a schematic elevational view of a detecting mechanism.

The label applying device 11 referred to above includes a rotation detecting mechanism 37 positioned adjacent the drive motor 25, said rotation detecting mechanism 27 being operable to detect the amount of vertical movement or reversal in operation of the suction head 35. This rotation detecting mechanism 37 comprises, as shown in FIG. 3, a rotary disc 38 fixedly mounted on the rotary shaft 25*a* of the drive motor 25, and first and second sensors 39 and 40 positioned radially outwardly of the rotary disc 38 and spaced an appropriate distance from each other in a direction circumferentially of the rotary disc 38. The rotary disc 38 has a circular row of a plurality of through-holes 38*a*, . . . and 38*a* equally spaced from each other at a predetermined pitch in a direction circumferentially of the rotary disc 38. The circumferential angle $(\alpha+\theta)$ between the first sensor 39 and the second sensor 40 with respect to the rotary shaft 25*a* is chosen to be larger by an angle $\theta$ than the circumferential angle $\alpha$ formed between each neighboring through-holes 38*a* and 38*a* with respect to the rotary shaft 25*a*.

More specifically, design is such that, as shown in this figure, in a phase condition in which an arbitrary one of the through-holes 38*a* is brought to a position in register with a detecting portion 39*a* of the first sensor 39, another one of the through-holes 38*a* spaced one pitch from said arbitrary one of the through-holes 38*a* in a counterclockwise direction can be held at a position offset a predetermined angle $\theta$ relative to a center of a detecting portion 40*a* of the second sensor 40.

Figure 4:
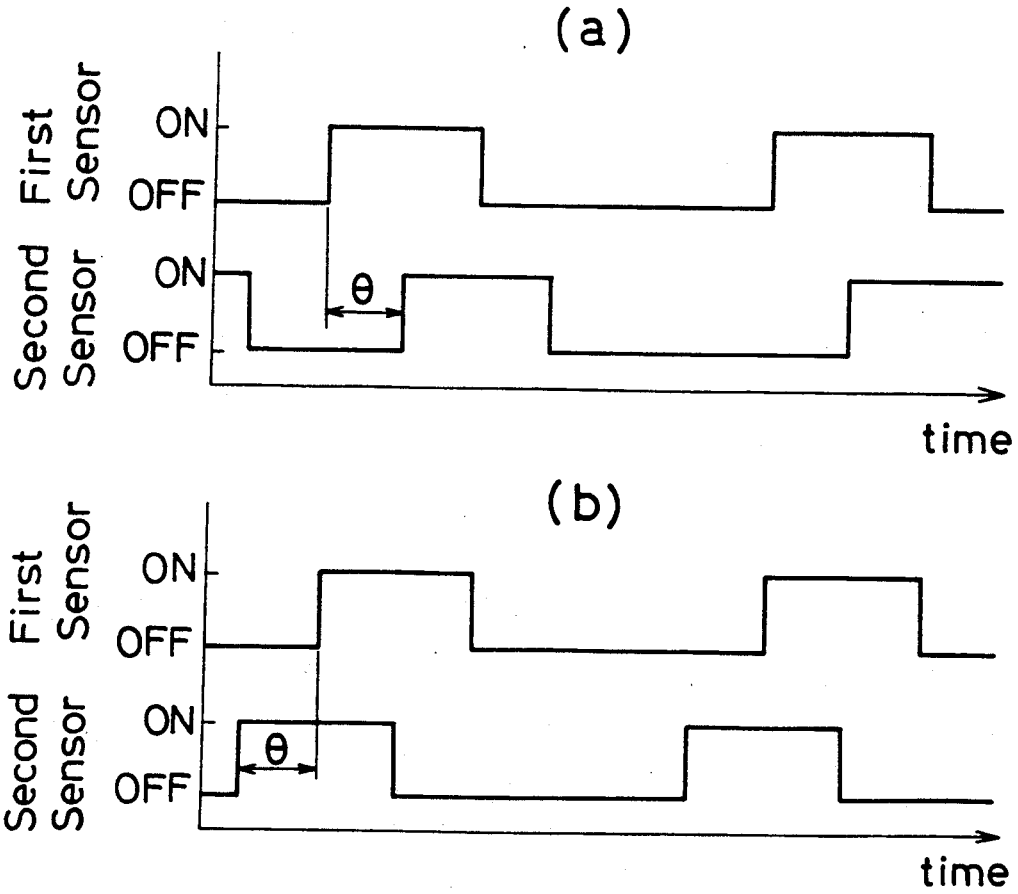
FIG. 4 is charts showing output characteristics of first and second sensors.

In such case, assuming that the clockwise direction of the rotary shaft 25*a* is referred to as a positive rotating direction P of the drive motor 25 and that the counterclockwise direction of the rotary shaft 25*a* is referred to as a reversed rotating direction R of the drive motor 25, and when the rotary shaft 25*a* of the drive motor 25 is driven in the positive rotating direction P which is the clockwise direction, as shown in FIG. 4(*a*), the second sensor 40 is switched on and off at a phase delayed relative to the first sensor 39 by a length of time corresponding to the offset angle $\theta$, On the other hand, when the rotary shaft 25*a* of FIG. 3 is driven in the reversed rotating direction R which is the counterclockwise direction, the second sensor 40 is switched on and off at a phase advanced relative to the first sensor 39 by a length of time corresponding to the offset angle $\theta$. In this way, the rotation detecting mechanism 37 does not only detect the amount of the vertical movement of the lifting arm 34 and the suction head 35, but also detect a reversed rotation of the rotary disc 38 which is indicative of a somewhat upward leap of the suction head 35 that takes place as a reaction at the time of application of the label Z.

Hereinafter, a system structure of the above described packaging and labelling machine 1 will be described with reference to FIG. 5.

The control unit 41 includes a central processing unit (CPU) 42 for executing an arithmetic processing and various control processes, a read-only memory ROM 43 for storing operational programs, a rewritable random access memory RAM (a memory) 44 for the temporary storage of results of arithmetic operations and other data, and an input/output interface 45 for input and output interfacing. The operating unit 9*a* (FIG. 1) of the console box 9 is provided with a key input section 46 through which various control commands and numerical values are inputted, a system switch 47 for switching the system on and off, and a start switch 48 for powering the packaging and labelling machine on and off.

The central processing unit 42 receives, through the input/output interface 45, various signals fed from the first and second sensors 39 and 40 and operates in response to these signals to transfer data stored in the read-only memory 3 to the random access memory 44 and/or to cause the display unit 9*a* to display various data read from the read-only memory 43 and/or the random access memory 44.

Also, the central processing unit 42 calculates the price of the product Y to be wrapped on the basis of the weight signal fed thereto from the weighing mechanism 3 through the input/output interface 45, writes the resultant data in a predetermined area of the random access memory 44, outputs a print signal to the label printer 10 through the input/output interface 45 so that the weight and the price of the product can be printed on the label together with data such as product name stored in the random access memory 44 beforehand, and issue the printed label. Furthermore, the central processing unit 42 can cause the drive motor 25 to be driven, in a manner as will be described later, so that the printed label Z sucked onto the lower face of the cushioning member 35*a* of the suction head 35 of FIG. 2 can be applied to the wrapped product Y then positioned at the wrapping station S therebelow.

On the other hand, the random access memory 44 (FIG. 5) is provided with, and stores data of, master files in which, for each kind of products, product data such as name and unitary price for a particular product number, tray data such as tray number, wrapping condition and tray size and the height of each product (the thickness of the product including the tray) are recorded, as shown in FIG. 6.

The above described central processing unit 42 shown in FIG. 5 has built therein a descent detecting means 51, a power cutting means (drive interrupting means) 52, a reversal detecting means 53, a drive direction reversing means 54 and a descend amount calculating means 55, all of which will be described hereinafter.

The above described descend amount calculating means is operable to calculate, on the basis of the height of the product stored in the random access memory 44, a preset lowering amount by which the suction head 35 shown in FIG. 2 is to be lowered by the drive of the drive motor 25.

Figure 5:
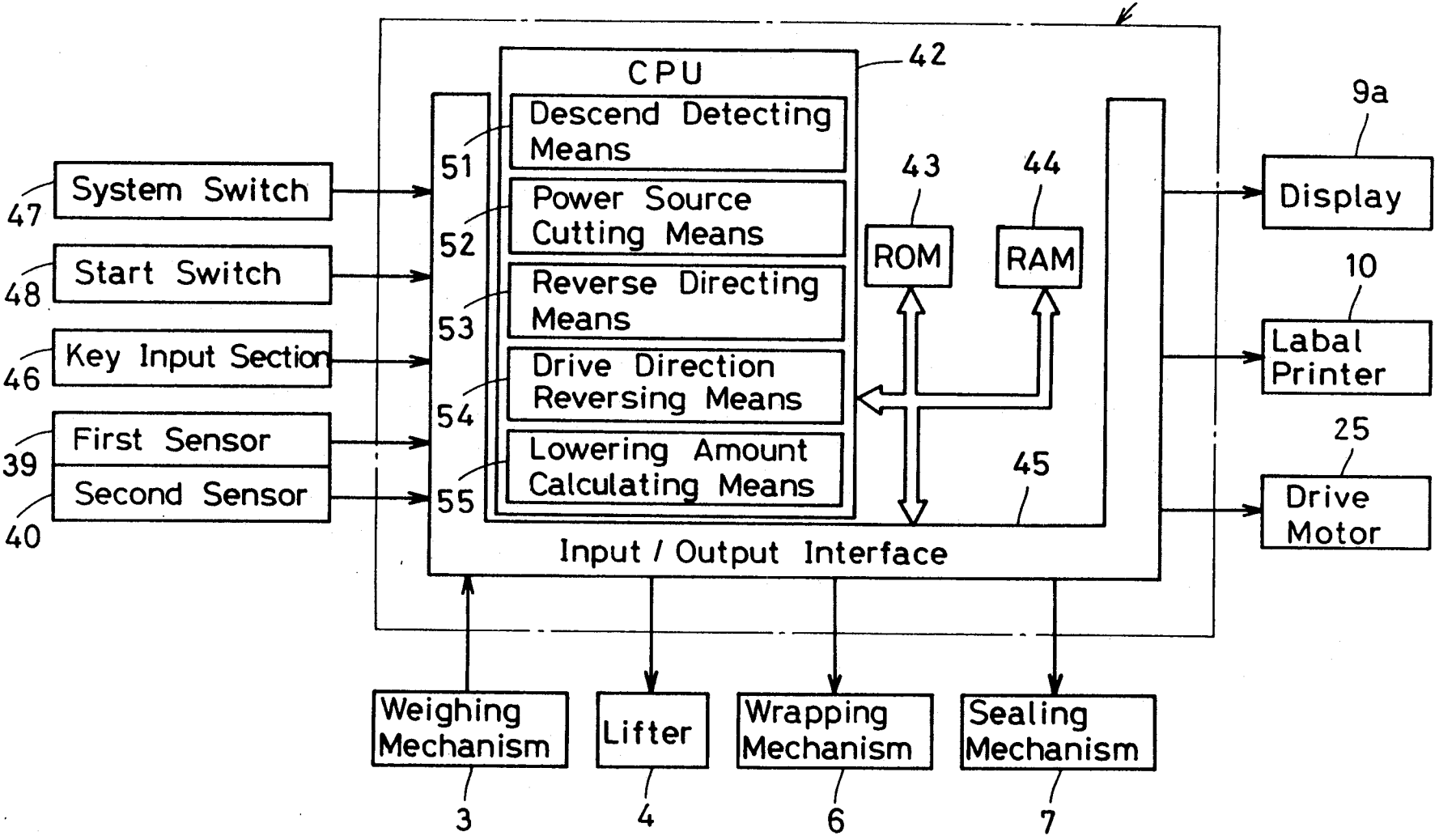
FIG. 5 illustrates a control system of the packaging and labelling machine.

The above described descent detecting means 51 shown in FIG. 5 is operable to detect a lowering of the suction head to a predetermined position by counting the number of pulse signals from the first sensor 39 and comparing the amount of the vertical movement of the lifting arm 34 and the suction head 35 with the above described preset lowering amount.

The above described power cutting means 52 shown in FIG. 5 is operable to interrupt the drive to the drive motor 25 by interrupting a supply of an electric power to the drive motor 25 when the above described descend detecting means 51 detects the lowering of the suction head 35 (FIG. 2) to the predetermined position.

The above described reversal detecting means 53 is operable to judge a change in direction of rotation of the rotary shaft 25*a* by detecting a change in waveform of the respective pulse signals, outputted from the first and second sensors 39 and 40 when the drive of the drive motor 25 is interrupted, from a state shown in FIG. 4(*a*) to a state shown in FIG. 4(*b*) and then to output a reverse signal by detecting an initial upward leap of the suction head 35 of FIG. 9 as a result of the reaction at the time of application.

The above described drive direction reversing means 54 shown in FIG. 5 is operable to drive the drive motor 25 in a reverse direction when the drive direction reversing means 54 receives the reverse signal.

Hereinafter, one method of operating the packaging and labelling machine 1 utilizing the above described label applying device 11 will be described.

When the product Y to be wrapped is placed on the weighing mechanism 3 shown in FIG. 2, a weight data thereof is transferred to the control unit 41 (FIG. 5), the price of this product is then calculated, the price, the weight and other items thereof are outputted to the label printer 10 together with the product name and other items retrieved from the product master file, and the printing of the label Z is carried out. After this printing, the product Y to be wrapped is lifted by the lifter 4 together with the tray X towards the wrapping station S at which the product X is subsequently wrapped taut by the film 5 then retained in a stretched fashion. After this wrapping, the label Z is automatically applied to the wrapped product Y and this application of the label Z is, in the embodiment now under discussion, carried out in the following manner.

At the outset, the central processing unit 42 (FIG. 5) reads out the height of the product as a whole corresponding to a particular product number stored in the product master file and, then, based on this height, the descend amount calculating means 55 calculates a preset lowering amount by which the lifting arm 34 and the suction head 35 are to be lowered during the drive. In other words, the central processing unit 42 determines the height shortly before the wrap product Y at which height the descent movement of the suction head 35 is switched to the lowering under the effect of an inertia.

Once the preset lowering amount for the lifting arm 34 has been determined, the central processing unit 42 outputs a positive drive signal to the drive motor 25. In this way, the driven pulley 28 is driven through the transmission belt 27 and, incident to the rotation of the driven pulley 28, the timing belt 31 is driven to lower the lifting arm 34, having the suction head 35 coupled to the lower end thereof, downwardly from an initial position shown in FIG. 7.

During this lowering, the central processing unit 42, when the lifting arm 34 is determined by the signal from the first sensor 39 (FIG. 3) as having been lowered a distance equal to the preset lowering amount, interrupts a supply of the electric power to the drive motor 25 thereby to interrupt the drive of the suction head 35 in an applying direction. In this way, the lifting arm 34 and the suction head 35 are, as shown in FIG. 8, allowed to descend under the effect of an inertia from a position shortly before the suction head 35 reaches the top face of the wrapped product Y. During the descend under the effect of an inertia, resistance acts on an interior of the drive motor 25 and portions of the guide rods 33 and, therefore, the suction head 35 is substantially braked so that, as shown in FIG. 9, the suction head 35 can be smoothly brought into contact with the top face of the wrapped product Y to apply the label Z onto the top face of the wrapped product Y.

Here, by a reaction induced by the contact of the cushioning member 35*a* of the suction head 35 against the wrapped product Y, that is, by a reaction induced upon application of the label Z, the suction head 35 leaps somewhat upwardly. The reversal detecting means 53 of the central processing unit 42 shown in FIG. 5 operates in response to the signals from the first and second sensors 39 and 40 to detect an initial leap of the suction head 35 (FIG. 9) by determining a reversal of rotation of the rotary shaft 25*a* (FIG. 3) from the positive drive state to the reversed drive state. After this detection, the drive direction reversing means 54 of the central processing unit 42 outputs the reverse drive signal to the drive motor 25. In this way, the suction head 35 shown in FIG. 9 is elevated with the cushioning member 35*a* shifted upwardly from a condition in which the cushioning member 35*a* is held in contact with the top face of the wrapped product Y, returning to the initial position as shown in FIG. 7.

Thus, since the detection is made of the upward leap of the suction head 35 by the effect of a reaction induced at the time the label Z is applied to the wrapped product Y and, after this detection, the suction head 35 is allowed to elevate, the suction head 35 can be assuredly brought into contact with the top face of the wrapped product Y. Accordingly, not only can the label Z be applied to the wrapped product Y with no fault, but also the necessity of ascertaining whether or not the label Z has been applied to the wrapped product Y is not required.

Also, since the electric power source of the drive motor 25 is cut off shortly before the arrival of the suction head 35 at the top face of the wrapped product Y, the suction head 35 can be smoothly brought into contact with the wrapped product Y with a minimized possibility of giving damage to the wrapped product Y.

In particular, in the embodiment now under discussion, since the suction head 35 is lowered by the drive motor 25 (FIG. 2), not by a pneumatic cylinder, the suction head 35 can be lowered at a predetermined speed and, because of this reason, no variation in stroke of lowering under the effect of an inertia occur substantially. Also, since, unlike the pneumatic cylinder, no unstable deceleration which would otherwise occur as a result of a change in viscosity of oil in sliding parts occur substantially, and therefore, no variation in stroke of lowering under the effect of an inertia occur substantially as well. Accordingly, there is no possibility that the stroke may exceed the predetermined value and, therefore, the wrapped product Y is hardly damaged as compared with the prior art.

Also, since the drive motor 25 (FIG. 2) is reversed once the power supply to the drive motor 25 is interrupted, a load imposed on the drive motor 25 (FIG. 2) can be minimized, thereby providing a merit in which a motor of low load capacitance can be utilized and, at the same time, since a loss at the time of reversal can be lessened, it leads to an increased speed.

Again, since the suction head 35 is elevated after the suction head 35 has initially leaped upwardly, any possible repeated contact of the suction head 35 with the top face of the wrapped product Y can be avoided. Accordingly, not only can any possible damage to the wrapped product Y be further avoided, but also the cycle time of application can further be shortened.

Furthermore, since the preset lowering amount for the suction head 35 is calculated on the basis of the height of the wrapped product Y read out from the random access memory 44, the necessity can be eliminated of a sensor which lowers together with the suction head 35 to detect whether or not the suction head 35 has approached the wrapped product Y. Accordingly, there is no possibility that lead wires of the sensor may be damaged or twined and, therefore, the device can exhibit an improved durability and an improved reliability.

It is to be noted that, although in the foregoing embodiment the preset lowering amount is calculated on the basis of the wrapped product Y, where the tray X has a height greater than the wrapped product Y, the height of the tray X may be recognized as representing the height of the wrapped product Y and, based on the height of this tray X, the preset lowering amount may be calculated.

It is to be noted that, although in the embodiment under discussion the preset lowering amount of the suction head 35 has been described as determined on the basis of the height of the wrapped product Y read out from the random access memory 44 (FIG. 5), the height of the wrapped product Y detected during the transport thereof within the packaging and labelling apparatus shown in FIG. 2 may be utilized. In such case, as shown by the double-dotted line, a product detecting sensor 56 comprising a light projector **56*a* and a light receiver 56*b* is to be disposed laterally upwardly of the lifter 4. This product detecting sensor 56 is fixed on a frame 60 and is operable to detect an upper edge of the product Y to be wrapped during the upward movement of the product Y to be wrapped. Also, the central processing unit 42 (FIG. 5) is to be provided with a height calculating means (not shown) for calculating the height of the product Y to be wrapped on the basis of a length of time that passes subsequent to the start of elevation of the lifter 4 and prior to the detection by the product detecting sensor 56 of the product Y to be wrapped, that is, the length of time required to elevate the lifter 4. Furthermore, the descent amount calculating means 55** calculates the preset lowering amount on the basis of the height of the product determined by this calculation.

Yet, as a method for detecting the leap of the suction head 35, a direct contact may be detected by the provision of a limit switch to the suction head 35 other than the foregoing.

Figure 10:
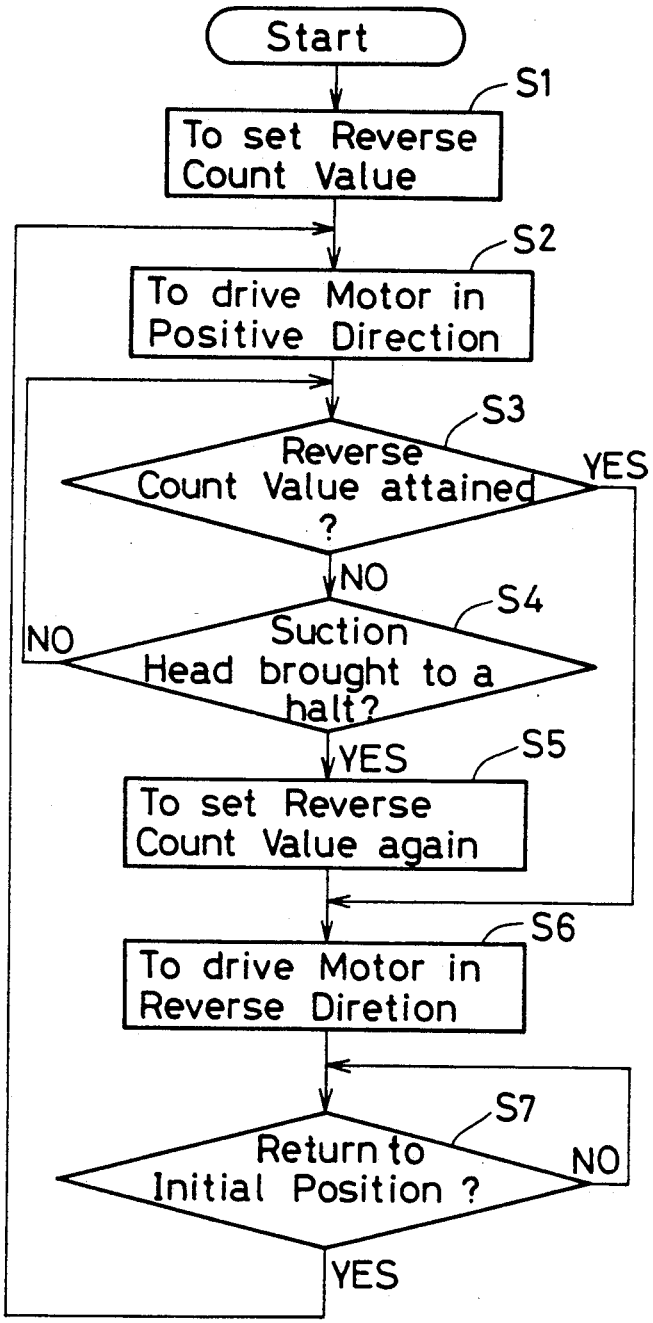
FIG. 10 is a flowchart showing a second embodiment.
Figure 11:
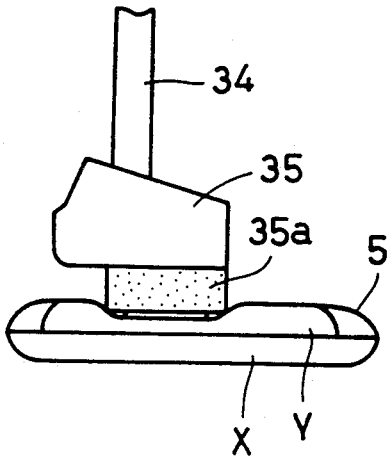
FIGS. 11 and 12 are side views showing the sequence of operation of the second embodiment.
Figure 12:
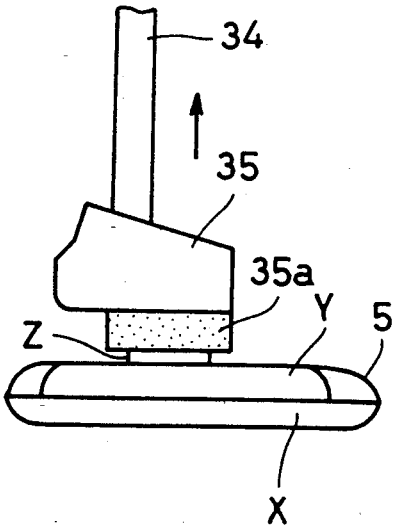

Hereinafter, a second embodiment of the present invention will be described with reference to FIGS. 10 to 12.

Although as hereinbefore described the preset lowering amount for the suction head 35 is determined on the basis of the height of the product Y to be wrapped, which has been determined beforehand, so that the product Y to be wrapped will not be pressed strongly, it may occur that, due to an error in setting, the product Y to be wrapped may even in this case be pressed excessively.

Therefore, in this embodiment, the lowering amount over which the suction head 35 is lowered is understood. The operation which the control unit 41 undergoes in such case will be described with reference to a flowchart shown in FIG. 10.

The control unit 41, after having set a reverse count value for the first sensor 39 of the rotation detecting mechanism 37 at step S1, goes to step S2 to drive the drive motor 25 in the positive direction. Then, at step S3, the control unit 41 determines if the pulse signal fed from the first sensor 39 has attained a value equal to the reverse count value and goes to step S4 when it determines "NO". At step S4, the control unit 41 determines if the suction head 35 has been brought to a halt and, then, in the event that it determines "YES", goes to step S5 at which the reverse count value is again set, followed by step S6 at which the drive motor 25 is driven in the reverse direction and, thereafter, the control unit 41 goes to step S7. At step S7, the control unit 41 determines if the suction head 35 has returned to the initial position and, in the event that it determines "YES", returns to step S2.

On the other hand, should the control unit 41 determines "YES" at step S3, the control unit 41 skips steps S4 and S5 to step S6 at which the drive motor 25 is driven in the reverse direction.

In this embodiment, as shown from step S3 to step S5, detection is made that, notwithstanding an attainment of the reverse count value, the suction head 35 has been brought to a halt and, at the time this has been detected, the reverse count value is set again. Accordingly, as shown in FIG. 11, in the event that the suction head 35 is excessively lowered, the reverse count value is set again correspondingly. Therefore, after a subsequent cycle, as shown in FIG. 12, the suction head 35 is elevated after having lightly contacted the top face of the product Y to be wrapped.

Figure 13:
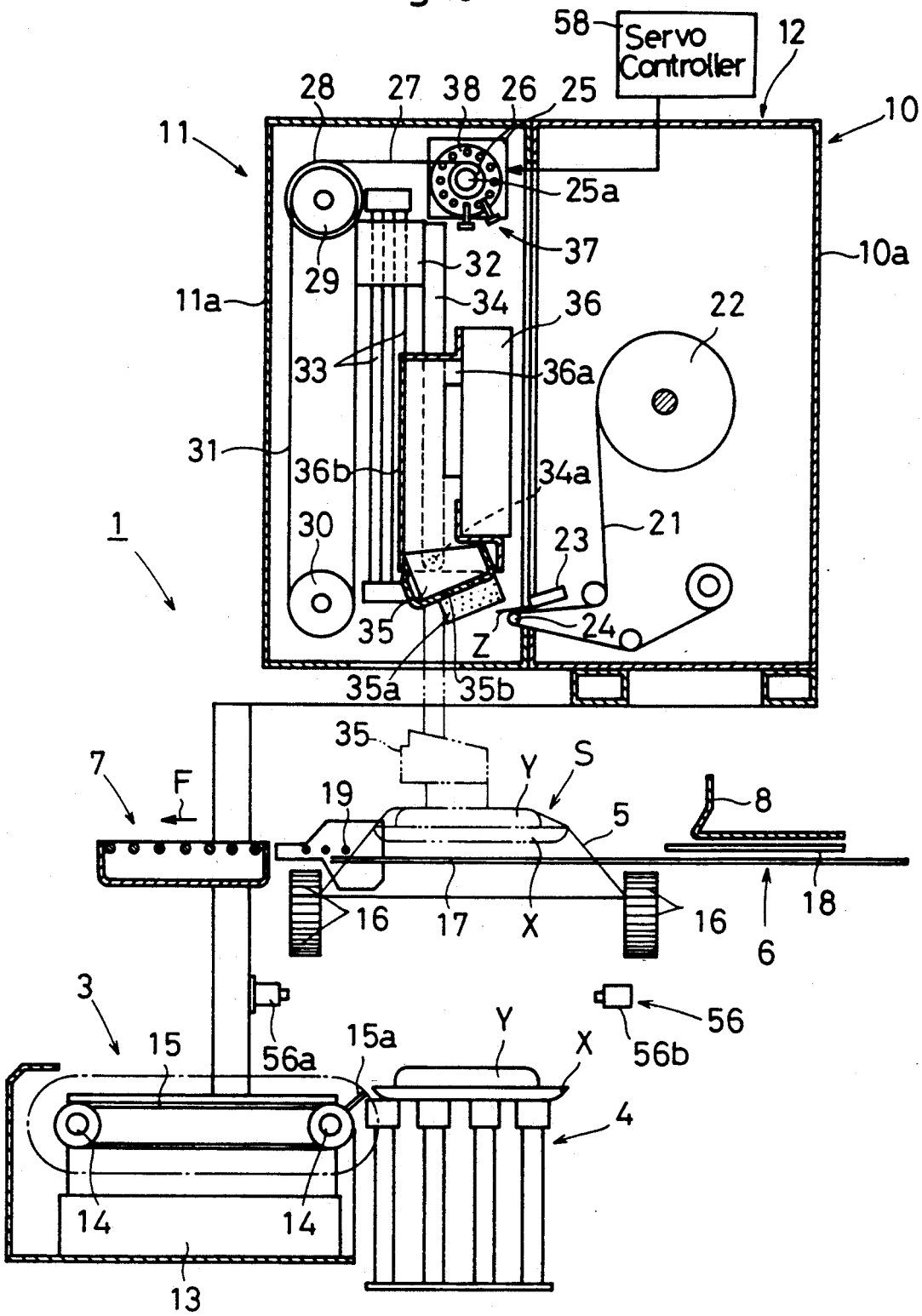
FIG. 13 is a schematic structural diagram of the label applying device according to a third embodiment.
Figure 14:
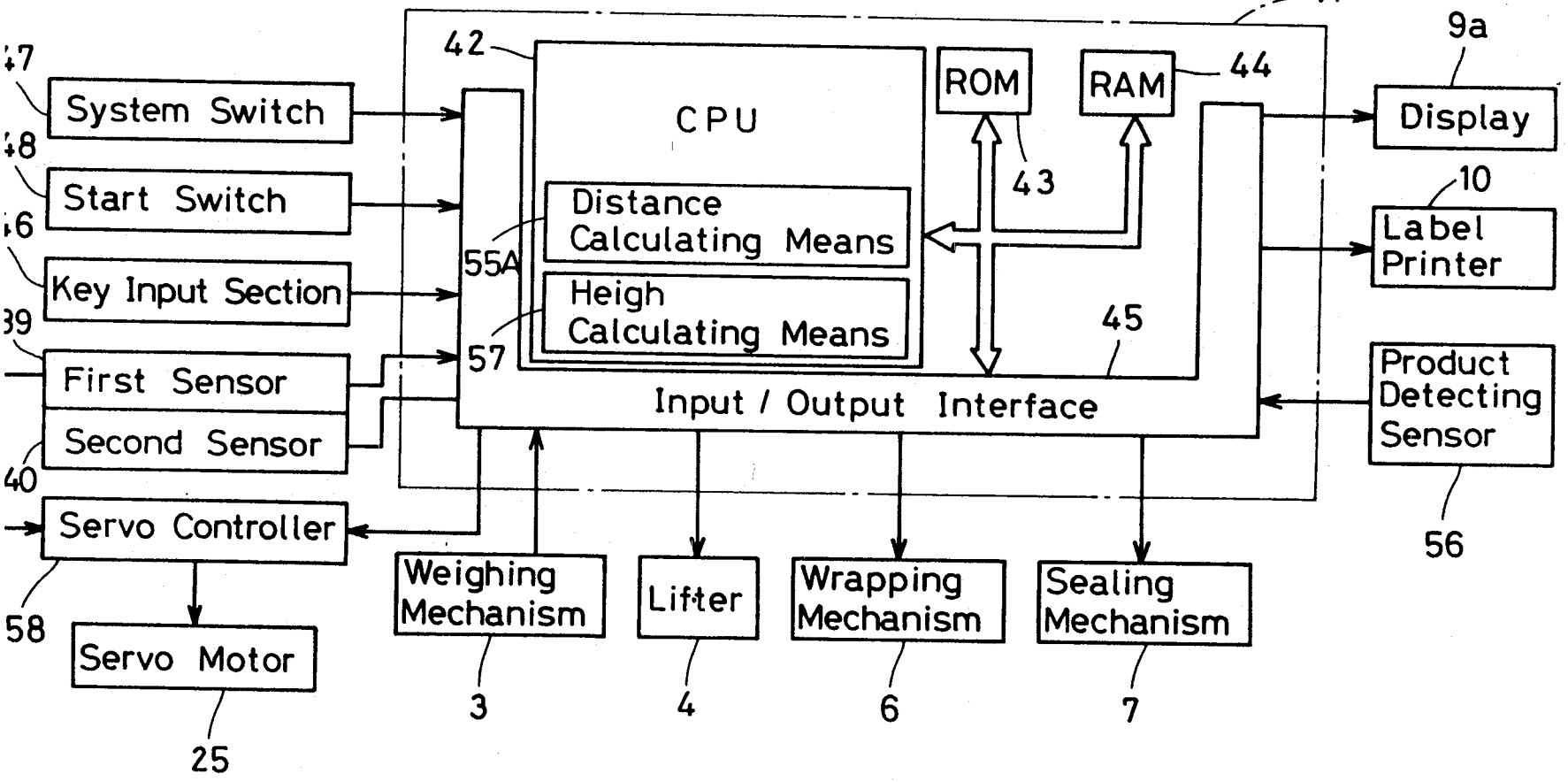
FIG. 14 illustrates the control system of the same packaging and labelling machine.
Figure 15:
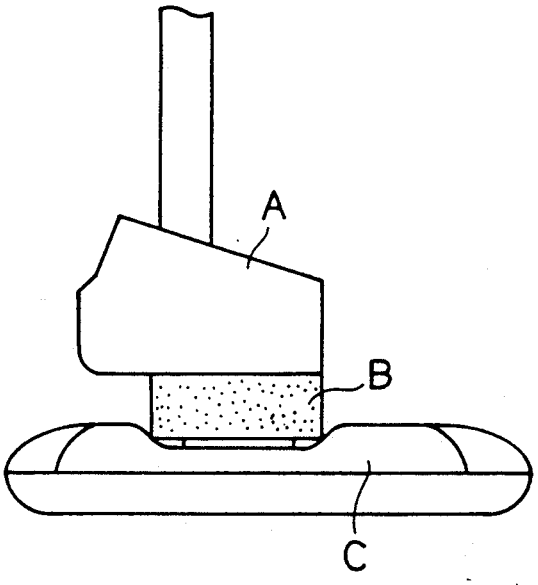
FIG. 15 is a side view showing a problem inherent in the prior art.

FIGS. 13 and 14 illustrate a third embodiment of the present invention.

Referring to FIG. 13, in this embodiment, a servo motor 25 is employed for the drive motor. The servo motor 25 is controlled by a servo controller 58. In this embodiment, there is employed a light projector **56*a* and a light receiver 56*b* constituting altogether the product detecting sensor 56 and disposed laterally upwardly of the lifter 4**.

Referring to FIG. 14, the central processing unit 42 is provided with a height calculating means 57 and a distance calculating means 55A. The height calculating means 57 is operable in response to a signal from the product detecting sensor 56 to calculate the height of the product Y to be wrapped on the basis of a length of time passed subsequent to the start of elevation of the lifter 4 shown in FIG. 13 and prior to the product detecting sensor 56 detecting the product Y to be wrapped, that is, the length of time required for the lifter 4 to complete its elevation. The distance calculating means 55A (FIG. 14) is operable to calculate, on the basis of the height of the product Y to be wrapped, the distance from the lower face of the cushioning member **35*a* in the suction head 35 to the top face of the product Y to be wrapped. The central processing unit 42 outputs to the servo controller 58** a signal indicative of the lowering amount which is somewhat greater than this distance.

The servo controller 58, by being acknowledged of the angle of rotation by the rotation detecting mechanism 37, lowers the suction head 35 at a high speed to a predetermined position, that is, the position at which the suction head 35 approaches the surface of the product Y to be wrapped, while continuing a detection of the position of the suction head 35, and then decelerates considerably from this approaching position to allow the servo motor 25 to be smoothly stopped. In this way, the label Z can be applied to the surface of the wrapped product Y while the suction head 35 has caved, for example, about 1 mm in the wrapped product Y. After this application, the servo motor 25 is immediately driven in the reverse direction to return to the initial elevated position.

Other component parts are similar to those in the first embodiment and, therefore, like parts are designated by like reference numerals while the details are herein omitted.

In this embodiment, since the servo motor 25 is controlled by the servo controller 58, it is possible to highly improve the accuracy with which the suction head 35 is brought to a halt at the required position. Accordingly, the label can be applied to the product without giving damage to the product.

It is to be noted that, even in this embodiment, instead of the height of the product Y to be wrapped being detected, arrangement may be made such that, while the height of the product Y to be wrapped that corresponds to a particular product number is inputted to the random access memory 44 beforehand, the servo motor 25 is controlled on the basis of this inputted data.

INDUSTRIAL APPLICABILITY

The present invention is utilized in a weighing and labelling system for weighing and labelling the price of products intended for sale in supermarkets.

What is claimed:

1. A labelling method for applying a label to a product by moving a suction head, carrying the label at a lower face of the suction head, downwardly towards the product positioned therebelow, which comprises steps of interrupting a drive of the suction head in an applying direction immediately before the suction head being lowered arrives at a label applying surface of the product to permit the label to be subsequently applied by the effect of an inertia operation, and detecting an upward leap of the suction head in response to a reaction which has occurred at the time of application of the label, and elevating the suction head after this detection.

2. A labelling method as recited in claim 1, wherein the suction head is elevated after the suction head leaps upwardly for the first time.

3. A labelling apparatus for applying a label to a product by moving a suction head, carrying the label at a lower face of the suction head, downwardly towards the product positioned therebelow, which comprises a drive means for moving the suction head up and down, a descent detecting means for detecting a lowering of the suction head down to a predetermined position, a drive interrupting means for interrupting the drive of the drive means in an applying direction in the event that the lowering of the suction head down to the predetermined position has been detected by the descent detecting means, a reverse detecting means for detecting a upward leap of the suction head when the drive of the drive means is interrupted, and a drive direction reversing means for driving the drive means in a reverse direction in response to a reverse signal fed from the reverse detecting means.

4. A labelling apparatus as recited in claim 3, wherein said drive means is constituted by a drive motor and said drive interrupting means is constituted by a power source cutting means operable to interrupt the supply of an electric power to the drive motor.

5. A labelling apparatus as recited in claim 3, wherein said drive direction reversing means is provided with means set to drive the drive means in the reverse direction in response to the initial upward leap of the suction head.

6. A labelling apparatus as recited in claim 3, further comprising a memory for storing the height of the product for each kind of the product, and a lowering amount calculating means for calculating the lowering amount, over which the suction head should be lowered while being driven, on the basis of the height of the product stored, said descent detecting means being operable to detect the lowering of the suction head down to the predetermined position on the basis of the said lowering amount.

7. A labelling apparatus as recited in claim 3, further comprising a lifter for elevating the product towards a wrapping station, a product detecting sensor secured to a frame for detecting an upper edge of the product while the product is elevated, a height calculating means for calculating the height of the product in reference to the length of time required to elevate the product before the product has been detected, and a lowering amount calculating means for calculating, on the basis of the height of the product so calculated, the preset lowering amount over which the suction head being driven is to be lowered, said descent detecting means being operable to detect the lowering of the suction head down to the predetermined position on the basis of the present lowering amount.

* * * * *

UNITED STATES PATENT AND TRADEMARK OFFICE

CERTIFICATE OF CORRECTION

PATENT NO. 5,254,189

DATED October 19, 1993

INVENTOR(S) Kenji Hirobe et al.

It is certified that error appears in the above-indentified patent and that said Letters Patent is hereby corrected as shown below:

Cover page, [75] Inventors: "Maplo" should be --Naoki--.

Col. 1, line 56, before "motion" insert --inertia--.

Col. 3, line 18, before "of" insert --consists--.

Signed and Sealed this

Eleventh Day of October, 1994

Bruce Lehman

*Attest:*

BRUCE LEHMAN

*Attesting Officer*

*Commissioner of Patents and Trademarks*